US005652961A

United States Patent [19]

Knight-Yurt

[11] Patent Number: 5,652,961

[45] Date of Patent: Aug. 5, 1997

[54] DETACHABLE HOSPITAL UNIFORM SCRUB TOP

[76] Inventor: Robin Lee Knight-Yurt, P.O. Box 5532, Woodridge, Ill. 60517

[21] Appl. No.: 580,875

[22] Filed: Dec. 29, 1995

[51] Int. Cl.[6] ..... A41D 13/00; A41D 27/20; A41B 1/08

[52] U.S. Cl. ..... 2/114; 2/247; 2/106

[58] Field of Search ..... 2/46, 48, 49.1, 2/49.2, 49.3, 49.4, 49.5, 50, 51, 52, 105, 106, 113, 114, 84, 69, 75, 80, 227, 247, 253, 115

[56] References Cited

U.S. PATENT DOCUMENTS

| | | | |
|---|---|---|---|
| D. 348,974 | 7/1994 | Whitwill | D2/860 |
| 1,397,729 | 11/1921 | Franklin | 2/253 |
| 1,489,046 | 4/1924 | Thompson | 2/114 |
| 2,642,576 | 6/1953 | Kotkes | 2/253 |
| 3,721,998 | 3/1973 | Mayers | 2/74 |
| 4,637,075 | 1/1987 | Ingrisano et al. | 2/102 X |
| 4,791,681 | 12/1988 | Dean | 2/106 |
| 4,876,724 | 10/1989 | Suzuki | 2/250 X |
| 5,142,702 | 9/1992 | Piloian | 2/102 |
| 5,182,812 | 2/1993 | Goldsby | 2/51 X |
| 5,361,412 | 11/1994 | Perry | 2/102 |

OTHER PUBLICATIONS

Gershman, Maurice, "Self Adhering Nylon Tapes." The L.A.M.A, vol. 68, No. 7, p. 930, Oct. 1958.

*Primary Examiner*—Jeanette E. Chapman
*Attorney, Agent, or Firm*—John D. Gugliotta; David L. Volk

[57] ABSTRACT

A new design for the clothing worn by hospital personnel known as, "scrubs", is disclosed, including a strap at the neck which forms a loop for holding a stethoscope. Detachable sleeves, also held together with Velcro, are also provided for enabling to user to take off the bottom part of the sleeve and wear standard length short sleeves and reattach them as needed. A two-pocket pouch at the waist area with two separate flaps covering these pockets are provided, and are secured shut by Velcro to the lower half one at a time or simultaneously. The area behind the two pockets creates a third, wide pocket. There is also a double pocket on the sleeve for pens, pencils, etc.

1 Claim, 1 Drawing Sheet

DETACHABLE HOSPITAL UNIFORM SCRUB TOP

BACKGROUND OF THE INVENTION

1. Field of the Invention

The present invention relates generally to garments and, more particularly, to a hospital uniform top convertible between long-sleeve or short-sleeve configurations.

2. Description of the Related Art

As is well known in the art, many garments are known, and many garments for use in a medical or hospital setting are also known. For example, in U.S. Pat. No. 3,721,998, issued in the name of Meyers, a hospital scrub dress is disclosed which is dimensionally adjustable and can therefor be utilized by women of differing sizes and shapes. Such a dress, however, is not very universally adaptable for various medical positions or throughout various seasonal climate variations.

Also, in U.S. Pat. No. 5,142,702, issued in the name of Piloian, an upper body ostomy garment is disclosed having an interior pocket for holding an ostomy appliance.

And finally, in U.S. Pat. No. Des. 348,974, issued in the name of Whitwill, an ornamental design for a disposable medical gown is disclosed.

Although these references disclose garments useable within a hospital environment, none attempt to make the staple "hospital scrub" more comfortable and functional during day to day, ordinary use. Consequently, a need has been felt for providing a garment having such adaptability and functionality.

SUMMARY OF THE INVENTION

It is therefore an object of the present invention to provide an improved hospital uniform scrub top.

It is yet another object of the present invention to provide an improved hospital uniform scrub top having a variety of specialty compartments which are readily adapted for use in day to day functioning within a hospital environment.

It is a feature of the present invention to provide an improved hospital uniform scrub top having detachable sleeves, held together with Velcro, which would enable a user to remove the sleeve into a standard short-sleeve configuration, or reattach the sleeves as needed.

Briefly described according to the preferred embodiment of the present invention, a new design for the clothing worn by hospital personnel known as, "scrubs", is disclosed, including a strap at the neck which forms a loop when the ends are brought together and held with Velcro brand hook and loop fasteners. Such a loop can be used for holding a stethoscope, for example. Detachable sleeves, also held together with Velcro, are also provided for enabling to user to take off the bottom part of the sleeve and wear standard length short sleeves and reattach them as needed. A two-pocket pouch at the waist area with two separate flaps covering these pockets are provided, and are secured shut by Velcro to the lower half one at a time or simultaneously. With the flaps closed, the area behind the two pockets creates a third, wide pocket. There is also a double pocket on the sleeve for pens, pencils, etc.

An advantage of the present invention is that the detachable sleeves allow a user to maintain environmental comfort in accordance with the building or exterior climatic conditions.

Another advantage of the present invention is that a variety of specialty compartments are provided which are readily adapted for use in day to day functioning within a hospital environment.

Further, a preferred embodiment of the present invention has hook and loop fasteners which make opening and closing, attaching and detaching quick, secure, and easy.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
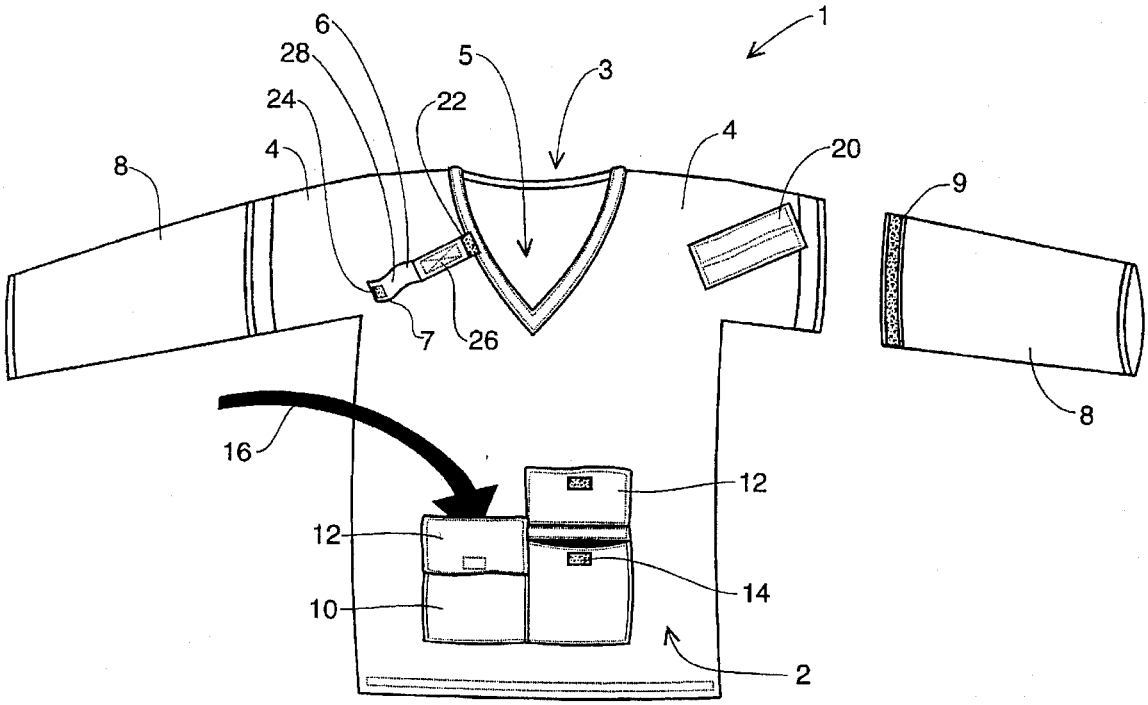
FIG. 1 is a front perspective view of a hospital uniform scrub top.

Referring now to FIG. 1, a hospital uniform scrub top 1 is shown, according to the preferred embodiment of the present invention, forming an otherwise conventional short-sleeved shirt having a front 2, a back 3, a pair of short sleeves 4, and a neck opening 5. A stethoscope strap 6 is affixed to the front near the neck 5. The stethoscope strap 6 forms a loop when the ends are brought together and held with a first hook and loop fastener 7. Such a loop can be used for holding a stethoscope, for example. Detachable sleeves 8, also held to the ends of the short sleeves 4 with a second hook and loop fastener 9, are also provided for enabling to user to take off the bottom part of the sleeve 8 and wear standard length short sleeves and reattach them as needed. A two-pocket pouch 10 at the waist area is also affixed to the front 2, as is shown in greater detail in conjunction with FIG. 2. With two separate flaps 12 covering these pockets, a third hook and loop fastener 14 are provided for securing shut the flaps 12 one at a time or simultaneously. With the flaps 12 closed, the area behind the two pockets 10 creates a third, wide pocket, as shown by the arrow 16. A fourth hook and loop fastener 18 is provided for closing the third, wide pocket 16 to the front 2. There is also a double pen pocket 20 on the sleeve for pens, pencils, etc.

Referring back to FIG. 1, the strap 6, described in another way, includes a first end 22 and a second end 24. The first and second ends 22, 24 each include cooperatively mating parts of a hook and loop fastening system 7 thereon. The strap 6 further includes a first portion 26 near the first end 22, the first portion 26 being fixedly attached to the front 2 of the shirt. The strap 6 further includes a second portion 28 near the second end 24, the second portion 28 and the second end 24 each being unattached to the shirt. The second end 24 is positioned lower than the first end 22 when the shirt is worn in a conventional manner by a person in an upright position. When the strap 6 is thus configured and the first and second ends 22, 24 are fastened together to form a loop, a stethoscope may rest solely within the loop.

Figure 2:
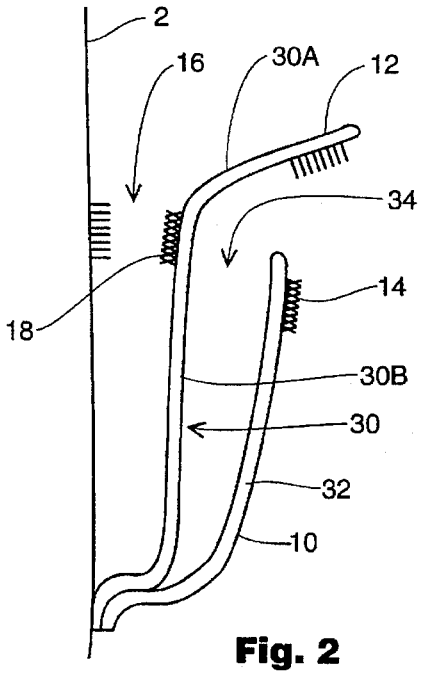
FIG. 2 is a cross sectional view of the front pocket section thereof.

Referring primarily to FIG. 2, the pocket configuration near the waist area of the shirt, described in another way, includes a first panel 30 fixedly attached to the front 2 of the shirt in such a manner as to form the third pocket 16. A first panel top portion 30A is configured to fold down and over a second panel 32. The second panel 32 is fixedly attached to the shirt and to a bottom portion 30B of the first panel 30 in such a manner as to form a second pocket 34 delimited by the second panel 32 and the bottom portion 30B of the first panel 30. The bottom portion 30B of the first panel 30 is disposed between the front 2 of the shirt and the second panel 32. The fourth hook and loop fastener 18 releasably secures the first panel 30 to the shirt at a location between the first panel top portion 30A and the bottom portion 30B. The third hook and loop fastener 14 releasably secures the first panel top portion 30A to the second panel 32 when the first panel top portion 30A is folded down over the second panel 32.

2. Operation of the Preferred Embodiment

In accordance with a preferred embodiment of the present invention, as shown in the figures, the hospital uniform scrub top 1 is utilized as one would normally utilize such a garment. The detachable sleeves 8 can be added or removed, in order to coordinate the user's comfort with the ambient climatic conditions. A stethoscope, a universally utilized piece of hospital equipment, can be affixed within the stethoscope strap 7, and pens or pencils can be easily stored on the users sleeve within the pen pocket 20.

The foregoing description is included to illustrate the operation of the preferred embodiment and is not meant to limit the scope of the invention. The scope of the invention is to be limited only by the following claims.

What is claimed is:

1. A medical scrub shirt comprising:

a. two short sleeves and two sleeve extensions;

b. a first hook and loop fastening means for detachably mounting the sleeve extensions to the short sleeves;

c. a single stethoscope strap attached to a front of the shirt and having a first end and a second end, the first and second ends having cooperatively mating parts of a second hook and loop fastening means attached thereto, so that the strap may form a loop when the first and second ends are fastened together;

d. the strap including a first portion near the first end and a second portion near the second end;

e. the first portion fixedly attached to the shirt and the second portion and the second end each unattached to the shirt;

f. the second end positioned lower than the first end when the shirt is being worn in a conventional manner by a person in an upright position, whereby a stethoscope may rest solely within the loop formed by the strap when the first and second ends are fastened together; a pocket configuration including:

i. a first panel fixedly attached to the shirt in such a manner as to form a first pocket;

ii. a first panel top portion configured to fold down and over a second panel;

iii. the second panel fixedly attached to the shirt and to a bottom portion of the first panel in such a manner as to form a second pocket delimited by the second panel and the bottom portion of the first panel; and the bottom portion of the first panel disposed between the shirt and the second panel;

iv. a first closure means for releasably securing the first panel to the shirt at a location between the top and bottom portions; and v. a second closure means for releasably securing the first panel top portion to the second panel when the first panel top portion is folded down and over the second panel.

* * * * *